US005333397A

United States Patent [19]

Hausch

[11] Patent Number: 5,333,397

[45] Date of Patent: Aug. 2, 1994

[54] INFLATABLE VENTILATING INSOLE

[75] Inventor: Duane D. Hausch, Red Wing, Minn.

[73] Assignee: Red Wing Shoe Company, Inc., Red Wing, Minn.

[21] Appl. No.: 16,964

[22] Filed: Feb. 12, 1993

[51] Int. Cl.[5] ..... A43B 7/06

[52] U.S. Cl. ..... 36/3 B; 36/3 R

[58] Field of Search ..... 36/3 R, 3 A, 3 B, 29, 36/35 B, 44, 28, 35 R, 37, 43, 71

[56] References Cited

U.S. PATENT DOCUMENTS

| | | | |
|---|---|---|---|
| 1,804,533 | 5/1931 | Jandoc et al. . | |
| 2,010,151 | 8/1935 | Helwig . | |
| 2,329,573 | 9/1943 | Ziegliss . | |
| 2,354,407 | 7/1944 | Shaks . | |
| 2,604,707 | 7/1952 | Hicks . | |
| 2,716,293 | 8/1955 | Rath . | |
| 2,887,793 | 5/1959 | Starr . | |
| 3,027,659 | 4/1962 | Gianola . | |
| 3,128,566 | 4/1964 | Burlison et al. . | |
| 3,225,463 | 12/1965 | Burnham . | |
| 3,284,930 | 11/1966 | Baldwin . | |
| 3,331,146 | 7/1967 | Karras . | |
| 3,410,006 | 11/1968 | Vogel | 36/3 R |
| 3,475,836 | 11/1969 | Brahm . | |
| 3,716,930 | 2/1973 | Brahm . | |
| 3,754,339 | 8/1973 | Terasaki . | |
| 3,791,051 | 2/1974 | Kamimura . | |
| 4,224,746 | 9/1980 | Kim . | |
| 4,309,831 | 1/1982 | Pritt . | |
| 4,364,186 | 12/1982 | Fukuoka . | |
| 4,420,893 | 12/1983 | Stephan . | |
| 4,438,573 | 3/1984 | McBarron . | |
| 4,499,672 | 2/1985 | Kim . | |
| 4,633,597 | 1/1987 | Shiang . | |
| 4,654,982 | 4/1987 | Lee | 36/3 B |
| 4,760,651 | 8/1988 | Pon-Tzu . | |
| 4,776,109 | 10/1988 | Sacre . | |
| 4,776,110 | 10/1988 | Shiang . | |
| 4,835,883 | 6/1989 | Tetrault et al. . | |
| 4,860,463 | 8/1989 | Pin . | |
| 4,888,887 | 12/1989 | Solow . | |
| 4,974,342 | 12/1990 | Nakamura . | |
| 4,991,317 | 2/1991 | Lakic . | |
| 4,993,173 | 2/1991 | Gardiner . | |
| 4,995,173 | 2/1991 | Spier . | |
| 4,999,932 | 3/1991 | Grim . | |
| 5,010,661 | 4/1991 | Chu . | |
| 5,025,575 | 6/1991 | Lakic . | |
| 5,068,981 | 12/1991 | Jung . | |
| 5,086,572 | 2/1992 | Lee . | |
| 5,195,254 | 3/1993 | Tyng | 36/3 B |

FOREIGN PATENT DOCUMENTS

| | | | |
|---|---|---|---|
| 135259 | 2/1909 | Fed. Rep. of Germany | 36/3 B |
| 1024960 | 1/1953 | France | 36/3 R |
| 2569955 | 3/1986 | France | 36/3 B |
| 2614510 | 11/1988 | France | 36/3 B |
| 6578 | of 1899 | United Kingdom | 36/3 R |
| 2189679 | 11/1987 | United Kingdom | 36/3 B |

OTHER PUBLICATIONS

Poron Brochure, © Rogers Corporation, 1986.

*Primary Examiner*—Paul T. Sewell
*Assistant Examiner*—Thomas P. Hilliard
*Attorney, Agent, or Firm*—Merchant, Gould, Smith, Edell, Welter & Schmidt

[57] ABSTRACT

An insole for ventilating shoes or boots comprising an air intake passage, an inflatable elastic bladder, an air exhaust passage, a ventilating capillary, and valve means. The bladder is formed along the peripheral area of the heel portion of the insole. Periodic application and release of pressure to the bladder causes air to flow out of the ventilating capillaries, thus cooling and drying the foot.

5 Claims, 2 Drawing Sheets

INFLATABLE VENTILATING INSOLE

FIELD OF THE INVENTION

This invention relates to insoles for shoes and boots, and more particularly to an inflatable air-ventilating insole.

BACKGROUND OF THE INVENTION

Many kinds of footwear, such as athletic shoes, everyday walking shoes, and work boots have the drawback of poor ventilation. Poor ventilation causes a moist, muggy environment in the shoe which can lead to unpleasant foot odor and foot discomfort for the wearer.

There have been various attempts to solve the problem of ventilating a shoe. Many of the approaches have included a bladder encased within the sole of the shoe. Generally, the weight of the foot is used to compress the bladder and force air out of apertures to ventilate the foot.

However, several problems exist with the prior art attempts to solve the ventilation problem using a bladder. Prior art devices have typically placed the bladder in the center of the heel portion of the sole. As a result, the bladder deflates very easily, causing the shoe to lose its shock-absorbing properties. This results in loss of heel cushion and, therefore, wearer discomfort.

Problems have also existed with failure of the bladder to reinflate. The shape and position of the bladder, or air pump, has been such that enough weight is always on it to prevent full inflation. This results in inefficient operation of the pump.

Most of the prior art devices are sufficiently built into the shoe so that they are not easily replaceable. Thus, should the ventilating capability of the shoe wear out, the user would have to either replace the whole shoe or tolerate poor ventilation.

The intake venting of many prior art devices leads out to the side of the shoe. This could cause water to be sucked into the inside of the shoe. Although such a design is not a serious problem in an athletic shoe, it would prove disastrous in a work or hunting shoe.

Finally, the prior art devices do not take into account the physiology of the foot during walking. Foot physiology is critical to determining bladder shape and placement for optimum ventilation.

The physiology of the human foot and the biomechanics of how it functions during walking make the motion of the foot within a shoe very predictable. The foot basically makes an "S" pattern during walking. At the beginning of each step the foot strikes the ground on the outside edge of the heel. A lateral line drawn across the base of the heel would be about a five to ten degree angle relative to the walking surface.

The second phase is called pronation. This occurs when the weight bearing part of the foot transfers through a rolling motion, from the outside or lateral edge of the calcaneus across to the medial or inside portion of the ankle at the base of the tibia, and rests very briefly on the medial longitudinal arch. The weight at this point is resting on an arched structure whose points of contact are the first metatarsal head and the calcaneus. At this point, the flesh around the perimeter of the heel is displaced laterally from the calcaneus.

The weight then shifts back across the foot in the supination phase. The load is transferred across the tops of the metatarsal bones and back through the ankle structure to rest on the lateral arch created by the arc of the fifth metatarsal bone from the head to the cuboid bone. Where the pronation phase is sometimes called "rolling in," this phase can be referred to as "rolling out."

After the foot has progressed from the heel strike through the pronation and supination phases it finally ends with the push off. The weight is transferred back across the foot through the metatarsal arch. Finally, the phalange and sesamoids of the big or first toe and the phalanges of the second toe propel the person forward.

What has been needed is a simple, low cost insole for ventilating a shoe which: incorporates a bladder designed to reinflate between heel compressions; maintains heel cushion and wearer comfort; is easily replaceable; prevents moisture from being drawn into the shoe; and takes into account the physiology of the foot during walking to optimize ventilation.

SUMMARY OF THE INVENTION

According to the present invention, an insole for ventilating a shoe is provided.

The apparatus of the present invention comprises an insole for ventilating the shoe of a person. The insole includes fore, arch, and heel portions and comprises an inflatable elastic bladder, an air intake passage, air exhaust passages, and ventilating capillaries.

The bladder is located along the rear and inner peripheral area of the heel portion of the shoe. The location of the bladder is important for several reasons. First, it allows for sufficient cushioning of the heel. Second, it takes advantage of the physiology of the foot during walking to efficiently ventilate the shoe. As the foot rolls during the pronation stage of the walking motion, it pushes air along the bladder and allows the bladder to refill behind it. Third, it takes advantage of the spreading effect of the heel. The flesh around the perimeter of the heel is laterally displaced when weight is applied to the heel. Thus, there is pressure on the peripheral area of the heel portion of the insole only when the heel is bearing weight. Fourth, there is no pressure on the bladder while the foot is in the air. As a result, the bladder is allowed to fully reinflate between successive compressions by the heel.

The bladder includes an inlet port in fluid communication with the air intake passage and an air discharge port in fluid communication with air exhaust passages. The air intake passage is vented to the outer environment of the shoe. The air exhaust passages open to the inner environment of the shoe through the ventilating capillaries.

As the bladder is compressed by the heel, air is pumped through the air exhaust passages and out of the ventilating capillaries to ventilate the inner environment of the shoe. When the heel is lifted, the bladder reinflates, drawing air in through the air intake passage. This forces perspiration in its gaseous state out through the upper of the shoe, thus cooling and drying the foot.

DETAILED DESCRIPTION OF THE PREFERRED EMBODIMENT

Figure 1:
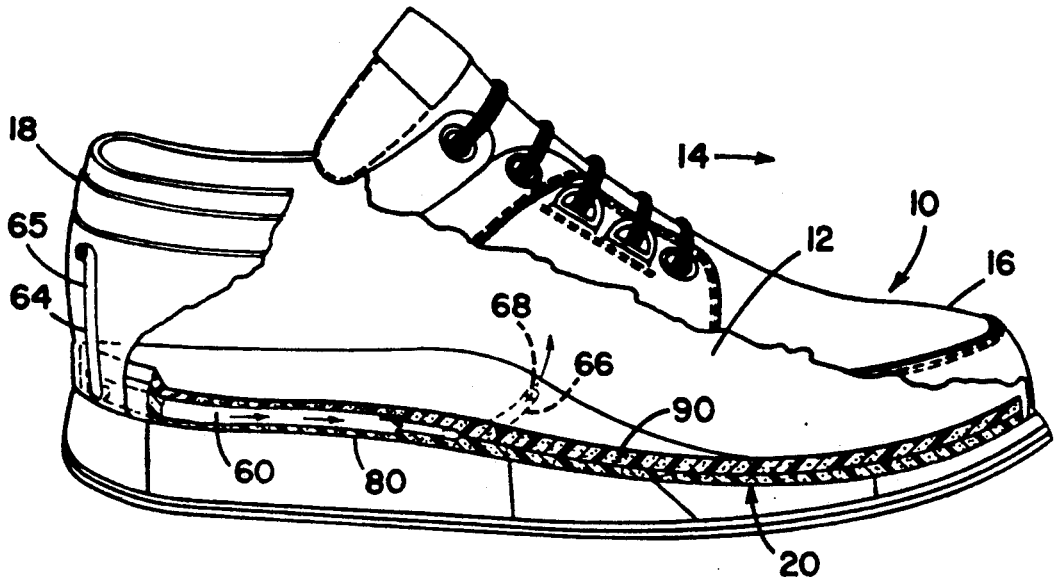
FIG. 1 is a perspective view of one embodiment of a ventilating insole according to the present invention, shown inserted in a shoe, portions thereof being broken away and shown in section.
Figure 2:
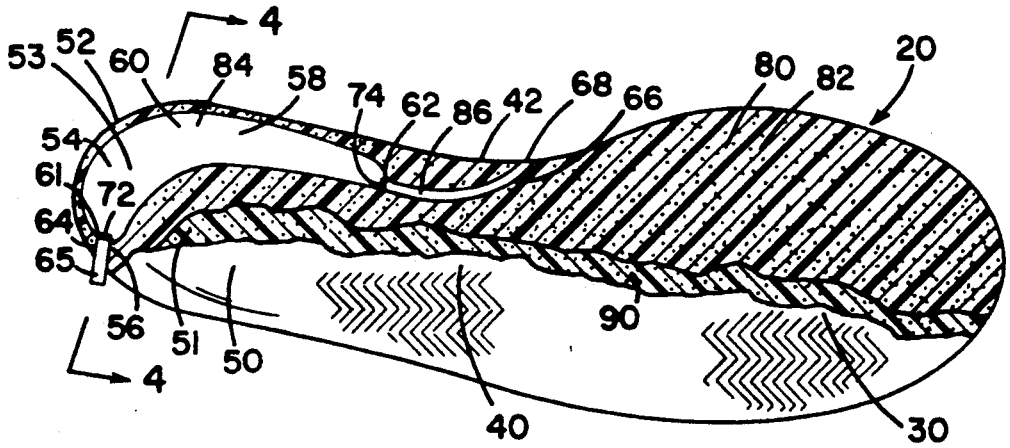
FIG. 2 is a top view of the insole of FIG. 1, portions thereof being broken away and portions being shown in section.
Figure 4:
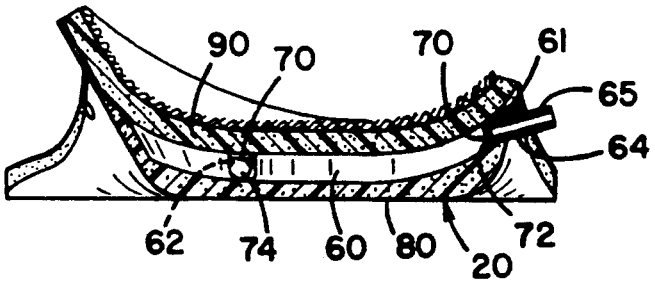
FIG. 4 is a cross-sectional view of the insole shown in FIG. 2, taken generally along the line 4—4 in FIG. 2.

Referring now to the drawings, and particularly to FIGS. 1, 2, and 4, there is illustrated one embodiment of a ventilating insole 20. Although the ventilating insole 20 is shown in FIG. 1 inserted into a standard walking shoe 10, the insole can be used with a variety of other walking devices, including athletic shoes and work boots.

The shoe 10 comprises an upper 16 having a heel portion 18, and has an inner environment 12 and an outer environment 14. The insole 20 comprises fore 30, arch 40, and heel 50 portions.

The heel portion 50 includes a generally centrally located heel support area 51, a peripheral edge 52, and a peripheral area 53 extending therebetween. The fore portion 30 includes an upper surface 34, and the arch portion 40 includes an inner edge 42.

An inflatable elastic bladder 60 is formed primarily along the peripheral area 53 of the heel portion 50. The bladder 60 is preferably formed substantially along the rear 54 and inner 58 peripheral portions of the peripheral area 53 and is preferably of a kidney shape in a generally horizontal plane of the insole, extending through the peripheral edge 52 of the heel portion 50 of the insole 20. However, those skilled in the art will recognize that a variety of shapes formed along the peripheral area 53 of the heel portion 50 could be employed.

The inflatable elastic bladder 60 includes an inlet port 61 and a discharge port 62. However, it will be understood by those skilled in the art that a number of inlet 61 or discharge 62 ports could be added. The inlet port 61 is preferably located at the outer side 56 of the rear peripheral portion 54, and the discharge port 62 is preferably located at the foremost end of the inflatable elastic bladder 60.

An air intake passage 64 extends to the inflatable elastic bladder 60 proximate the inlet port 61 and provides fluid communication between the air intake passage 64 and the bladder 60. Although the air intake passage 64 could take a variety of shapes and sizes, the preferred embodiment employs an air intake tube 65. The air intake tube 65 extends through the base of the upper 60 via a pressure fit. It is then generally vertically disposed along the outer wall of the heel portion 18 of the upper 60. The air intake tube 65 is preferably disposed from the outer side 56 of the rear peripheral portion 54 of the insole 20. This location is chosen to reduce the possibility of pinching off inlet air flow, while maintaining wearer comfort.

Figure 3:
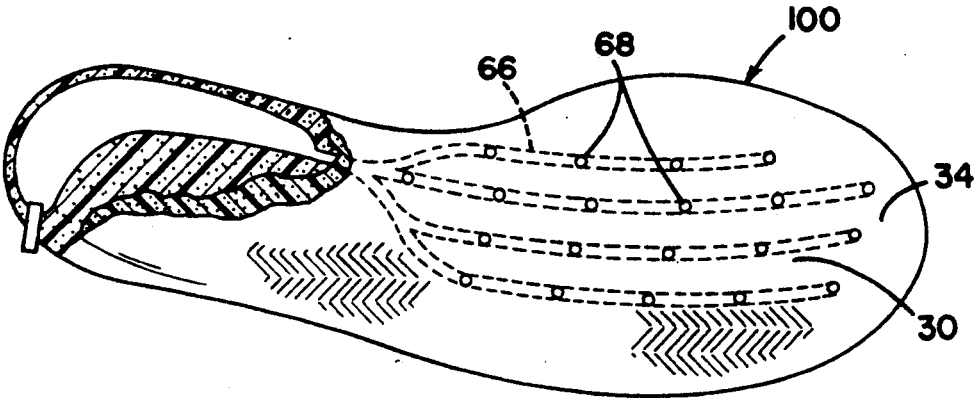
FIG. 3 is a top view of a second embodiment of a ventilating insole, similar to that of FIG. 2.

In the preferred embodiment, an air exhaust passage 66, in fluid communication with the inflatable elastic bladder 60 proximate the discharge port 62, extends to the inner edge 42 of the arch portion 40. Those skilled in the art will recognize that the air exhaust passage 66 can include a plurality of branches, as illustrated by the second preferred embodiment 100 in FIG. 3, which may also split into successive branches. The air exhaust passages 66 can also take a variety of shapes and sizes other than the channels employed in the preferred embodiment.

In the preferred embodiment of the present invention, a ventilating capillary 68 opens from the air exhaust passage 66 to the inner environment 12 of the shoe 10. The ventilating capillaries 68 can open from the terminus of an air exhaust passage 66, as illustrated by the first preferred embodiment 20 in FIG. 2, or they may open at various points along an air exhaust passage 66, as illustrated by the second preferred embodiment 100 in FIG. 3.

In the preferred embodiment an inlet valve 72 and a discharge valve 74 are employed to control air flow from the outer environment 14 to the ventilating capillaries 68. The inlet valve 72 is preferably positioned in the inlet port 61 of the bladder 60 and the discharge valve 74 is preferably positioned in the discharge port 62 of the bladder 60. Those skilled in the art, however, will recognize that the inlet 72 and discharge 74 valves can be positioned in a variety of locations along the air intake passage 64 and the air exhaust passage 66, respectively. The valves 72, 74 are preferably one-way valves. It will be understood that a single one-way valve 70 could be employed, although with less efficient functioning of the ventilating insole 20. Moreover, the ventilating insole 20 can function without any valves by using physics principles to restrict air flow at different stages of the walking step. The one-way valves 70 used in the preferred embodiment are flapper valves. Those skilled in the art, however, will recognize that a variety of other one-way valves 70 could be employed.

The basic operation of the preferred embodiment of the ventilating insole 20 is as follows. Air is sucked into the bladder 60 through the air intake tube 65. After the heel strikes the ground the air inlet valve 72 closes and air is rolled by the natural motion of the foot toward the air discharge port 62 where the discharge valve 74 has opened under pressure. Air is expelled through the air exhaust passages 66 and out the ventilating capillaries 68 as the bladder 60 deflates. The increased air pressure inside the shoe 10 forces moist air out through the semi-permeable upper 16, replenishing the inner environment 12 of the shoe 10 with fresh air. As the foot is lifted and pressure is removed from the bladder 60, the vacuum created by the reexpanding bladder 60 closes the discharge valve 74 and opens the inlet valve 72 to allow more fresh air to enter the bladder 60.

In the preferred embodiment, the inflatable elastic bladder 60 and air exhaust passages 66 are formed between a semi-rigid lower layer 80 and a flexible layer 90. Those skilled in the art, however, will recognize that the bladder 60 and the air exhaust passages 66 can be formed in a variety of ways within the insole 20, such as employing a balloon-type sack or tubing, respectively. In the preferred embodiment, the semi-rigid layer 80 has bladder 84 and passage 86 depressions in its upper surface 82. The flexible layer 90 is glued to the upper surface 82 of the semi-rigid layer 80, forming the inflatable elastic bladder 60 and the exhaust passages 66. The flexible layer 90 is made of a sponge-like material which elastically reverts to its normal shape after decompression, causing reinflation of the bladder 60 between successive compressions.

The semi-rigid layer 80 is preferably manufactured from a dense polyether urethane, such as blown AS URETHANE, and the flexible layer 90 is preferably made of a polyether urethane foam, such as PORON 4000. However, those skilled in the art will recognize that a variety of materials with similar properties could be substituted.

The flapper valves 70 employed in the preferred embodiment are thin L-shaped pieces of rubber. They are glued in place between the semi-rigid 80 and flexible 90 layers. The air intake tube 65 in the preferred embodiment consists of capillary tubing which is cemented between the semi-rigid 80 and flexible 90 layers proximate the air inlet port 61. Finally, a sock lining of woven nylon, such as CAMBRELLE, could be added to the upper surface of the flexible layer 90 to control perspiration between the foot and the flexible layer 90.

The ventilating insole 20 of the present invention is replaceable, should it loose its ventilating capability. The air intake tube 65 can be removed along with the insole 20 which can then be replaced with a new insole.

It will be understood by those skilled in the art that the present invention is not limited to the examples discussed above, which are illustrative only. Changes may be made in detail, especially in matters of shape, size, arrangement of parts, and material of components within the principles of the invention, to the full extent indicated by the broad general meanings of the terms in which the appended claims are expressed.

What is claimed is:

1. An insole for ventilating a shoe for a person having a heel, the show having an inner and an outer environment, said insole comprising:

(a) fore, arch, and heel portions, the heel portion having a generally centrally located heel support area, a peripheral edge, and peripheral area extending therebetween the peripheral area of the heel portion including rear and inner peripheral portions;

(b) an inflatable elastic bladder formed primarily along the peripheral area substantially along the rear and inner peripheral portions and being generally of a kidney shape in a plane extending through the peripheral edge of the heel portion, the bladder having an inlet port and a discharge port and being constructed and arranged to be compressed by the heel of the person, and to reinflate when the heel is lifted;

(c) an air intake passage in fluid communication with the inflatable elastic bladder at the inlet port and vented to the outer environment of the shoe;

(d) at least one air exhaust passage in fluid communication with the inflatable elastic bladder at the discharge port;

(e) at least one ventilating capillary opening from the air exhaust passage to the inner environment of the shoe; and (f) valve means for controlling air flow from the outer environment to the ventilating capillary, the valve means cooperating with the inflatable elastic bladder to pump air out of the ventilating capillary upon compression of the bladder and to draw air n through the air intake passage upon reinflation of the bladder.

2. The insole of claim 1 wherein the rear peripheral portion includes an outer side, and the air intake passage comprises an air intake tube in fluid communication with the inflatable elastic bladder, the air-intake tube being disposed from the outer side.

3. The insole of claim 1 wherein the arch portion of the insole includes an inner edge, and the ventilating capillary opens generally from the inner edge, the ventilating capillary opening from the air exhaust passage extending from the discharge port of the bladder, the discharge port being located at a foremost end of the bladder.

4. The insole of claim 1 wherein the inflatable elastic bladder and the air exhaust passage are formed between a lower layer having an upper surface, the lower layer having bladder and passage depressions in the upper surface, and a flexible layer secured to the upper surface so as to sealingly form the bladder and the air exhaust passage between the lower layer and the flexible layer, the flexible layer provide the primary elasticity required for reinflation of the bladder.

5. The insole of claim 4 wherein the lower layer is polyether urethane and the flexible layer is polyether urethane foam.

* * * * *

UNITED STATES PATENT AND TRADEMARK OFFICE
CERTIFICATE OF CORRECTION

PATENT NO. : 5,333,397

DATED : August 2, 1994

INVENTOR(S) : Hausch

It is certified that error appears in the above-identified patent and that said Letters Patent is hereby corrected as shown below:

Column 4, line 63; "AS" should read --AB--.

Column 5, line 25; "show should read --shoe--.

Column 5, line 30; insert --,-- after the word "therebetween".

Column 6, line 14; "n" should read --in--.

Column 6, line 36, claim 4; "provide" should read --providing--.

Signed and Sealed this

Tenth Day of January, 1995

*Attest:*

*Attesting Officer*

BRUCE LEHMAN

*Commissioner of Patents and Trademarks*